United States Patent [19]

Harris

[11] Patent Number: 4,942,829

[45] Date of Patent: Jul. 24, 1990

[54] WORK OF ART THAT TRANSFORMS INTO A DINING TABLE

[76] Inventor: Anne M. Harris, 40 W. 72nd St., New York, N.Y. 10023

[21] Appl. No.: 378,389

[22] Filed: Jul. 11, 1989

[51] Int. Cl.[5] ..... A47B 1/04

[52] U.S. Cl. ..... 108/79; 108/65

[58] Field of Search ..... 108/65, 115, 113, 79, 108/124, 160, 157

[56] References Cited

U.S. PATENT DOCUMENTS

| | | | |
|---|---|---|---|
| D. 132,907 | 6/1942 | Fitzpatrick | 108/79 X |
| 392,407 | 11/1888 | Chorman | 108/79 |
| 527,077 | 10/1894 | Rollings | 108/65 |
| 1,424,419 | 8/1922 | Malarkey | 108/79 |
| 1,516,323 | 11/1924 | Bilton | 108/79 |
| 1,758,196 | 5/1930 | MacKinnon | 108/79 |

*Primary Examiner*—Peter A. Aschenbrenner

*Attorney, Agent, or Firm*—Jones, Day, Reavis & Pogue

[57] ABSTRACT

The present invention relates to a gateleg table capable of serving as a dining room or conference table. When the table is completely extended to its fully opened position, it can sit up to twelve individuals (four individuals on each side and two individuals at each end). Each respective side of the base table legs contain stored support members which pivot horizontally to support a respective section of the table. The table has two drop-leaf members (one at each end), as well as two center surface members, and will fold to a closed position in an accordion-like fashion. In its fully closed position, the table has three top members which extend in substantially the same horizontal plane and which will facilitate placement of a removal top surface on the table. When in a partially opened position, the table can facilitate seating (of up to four individuals) by securing one of the drop-leaf members to its extended position and the pivoting a respective support member, which is kept in a recess in the base leg of the table, to its fully extended position. In a similar fashion, the table may be opened to another partially open position to accommodate seating of up to 8 individuals. Finally, at all times each exterior surface or edge of the table which is in plain view by an observer, whether the table is in a fully closed, fully opened or its semi-opened positions, are intended to satisfy the aesthetic artistic aspects as a stand alone work of art (e.g., painting or piece of sculpture). In an alternative embodiment, when the table is in its fully opened position, the table has a centrally disposed warming area for heating of items which are intended to be served.

5 Claims, 3 Drawing Sheets

WORK OF ART THAT TRANSFORMS INTO A DINING TABLE

BACKGROUND OF THE INVENTION

The present invention relates to the general field of tables, and more particularly to a four in-one gateleg dining or conference table which converts into a stand-alone work of art (painting and sculpture) when not being used as a table (e.g., as when in its fully closed position) thereby having both utilitarian and aesthetic qualities.

Typically most residences and commercial establishments occasionally experience a space utilization problem with respect to the optimum or most efficient arrangement of furniture within a finite amount of floor space. Various types of furniture have been developed which can be closed when not being used for purposes of minimizing the amount of space utilized by the piece of furniture when it is not being used and is in its closed position. Sometimes the specific design for a particular article of furniture does not permit the piece of furniture to perform a further utilitarian purpose when the article is in the closed position.

With respect to various prior art arrangements pertaining to tables used for dining, it has long been the practice that a well designed dining table will permit some functional utilization of the dining table when the table is in a semi-closed (or semi-opened) position. For example, perhaps the dining table will have a small central top surface which is capable of further utilization even when the table is in its closed position. This is of a particular concern for various individuals who reside in cramped quarters where there is only sufficient space to accommodate a single dining table which, of necessity, must be used for both informal and formal dining occasions on the part of the particular resident. A dining table that is capable of structurally facilitating partial dining (for up to three to eight individuals) in its semi-opened positions while still maintaining an inherent capability when in its fully opened position to comfortably seat twelve individuals for a formal dinner (or meeting), would pose a solution for those residences or businesses which occasionally have a space limitation problem. If the same dining table, when it its fully closed postion, could additionally be used for purposes of decorative design, the particular article of furniture would be a valuable addition to an occupant which finds itself with a permanent space limitation problem.

Another version of the space limitation problem arises when furnishing a residence or office with respect to functional articles of furniture and aesthetic works of art. Usually separate articles are purchased to fulfill the utilitarian demands of the occupant and different individual pieces of art are purchased to satisfy the inherent aesthetic interior requirements of the surrounding environment. Out of necessity, this exacerbates the space limitation problem of the occupant, not to mention the duplication of capital investment required to purchase each of the separate articles by the resident or tenant. Furthermore, the typical piece of furniture will depreciate in value over time as it becomes worn, while if wisely chosen, the selected work of art may maintain or even appreciate in value over time, thereby having the additional benefit of preserving the initial capital investment made by the owner over time, at least in absolute terms. The prior art has not demonstrated an article comprising of a work of art (painting or piece of sculpture) which is convertible into utilitarian piece of furniture, such as a table capable of being used as either a formal dining or conference table by the occupant.

Articles of convertible furniture of the prior art design and construction have generally used tongue-in-groove or peg-in-hole design approaches to achieve the necessary stability when the article of furniture is extended to its fully opened position. Unfortunately, one of the drawbacks to this particular standard design approach is that the specific item of furniture may not be able to be fully utilized in a functional sense when the particular piece of furniture is folded into its closed position. Consequently, there is a need for a piece of furniture to be sturdy and durable in either its opened or closed positions, while being able to complete tilitarian functions in either position, yet remain elegant and simplistic with respect to its underlying design and construction, and also have the capacity of fulfilling an incremental utilitarian function when the article of furniture is in its closed position.

The maintainability of any article of furniture is always a concern. Likewise, this is also true with respect to individual works of art. It is even more apparent that maintainability will be essential attribute with a article of furniture that would convert, say when in its closed position, into a separate stand-alone work of art. Such an article would have to be resistant to surface scratches or mars, as well as be able to withstand damage as a result of the frequent conversion from performing the utilitarian function as an article of furniture and then being transformed to perform the aesthetic function as a separate stand-alone work of art when the article of furniture is in its closed position.

OBJECTS OF THE INVENTION

It is an object of the present invention to provide a work of art which transforms into a dining or conference table capable of accommodating up to twelve individuals when in its fully opened position.

It is a another object of the present invention to provide an article of furniture which will fulfill various utilitarian purposes, as well as being aesthetically pleasing to the eye as a stand-alone work of art when the article of furniture is not used and is in its fully closed position.

It is a further object of the present invention to provide a gateleg dining table which has an inherent four-in-one capability. That is, as a separate stand-alone work of art when in its fully closed position, as a dining or conference table when in its semi-opened positions or its fully opened position (capable of seating from 4 to 12 individuals), and as a separate accessory table when in its fully closed position.

It is yet a further object of the present invention to provide a dining table which is simplistic and elegant in its underlying design and construction, yet which is sufficiently durable for its intended environment.

It is yet another object of the present invention to provide a separate work of art which transforms into an article of utilitarian furniture, both embodiments of which are designed to be easy to maintain by the owner.

SUMMARY OF THE INVENTION

In practicing the invention there is provided a gateleg table having an opened position, a partially opened position and a closed position. The table has a plurality of exterior and interior surfaces and edges which, when taken as a whole and when the table is in the closed position, comprise a stand-alone work of art (e.g., piece of sculpture or painting). The table has a pair of base support members, each base support member having a respective side, each side having a respective cavity of a predetermined size for storing an associated secondary support member when not in use. The table has a pair of substantially rectangular shaped drop-leaf members corresponding to each end of the table and a pair of substantially rectuangular shaped center surface members, which comprise the central top surface of the table, each member having a width of a predetermined dimension. The drop-leaf members are connected to a respective side near the top edge of the base support member. Each drop-leaf member has a top and bottom surface and on its bottom surface there is a continuous rectangular portion removed along its entire width.

In similar fashion, each center surface member is connected to a respective side near the top edge of the base support members. Each center surface member has a top and a bottom surface and on its bottom surface there is a continuous rectangular portion removed along its entire width. In one of the embodiments, the pair of center surface members has a centrally disposed recessed area adapted to receive suitable heating means and which are fully capable of heating items placed on the top surface. Conventional means are used to supply heating capabilities to the recessed area. In the center of the table a longitudinal hinge facilitates easy closing of the table to its closed position (in accordion-like fashion). The hinge extends the entire width of the table and is inlaid in the adjacent bottom surface of each center surface member. The table requires a plurality of secondary support members of a predetermined size to be in their extended positions, upon which will rest either of the drop-leaf members or center surface members. Inlaid hinges permit lifting of each drop-leaf member in a vertical direction to an extended position and are connected to a respective side of the base support member and to the bottom adjacent surface of the drop-leaf member. In a similar fashion, inlaid hinges permit lifting of each center surface member in a vertical direction to an extended position and are connected to a respective side of the base support member and to the bottom adjacent surface of said center surface member. Inlaid furniture hinges will permit the pivoting of the secondary support member in a horizontal direction to their extended position, wherein they will provide support to either an associated drop-leaf member or to an associated center section member of the table.

The gateleg table is capable of performing multiple (e.g., four-in-one) functions and when in the closed position will constitute a stand-alone work of art. The table may also be utilized as a table in its fully opened position (with seating for twelve individuals) or in its various partially opened positions (with seating from four to eight individuals) and in its fully-closed position with a removable top in place.

DETAILED DESCRIPTION OF THE INVENTION

Figure 1:
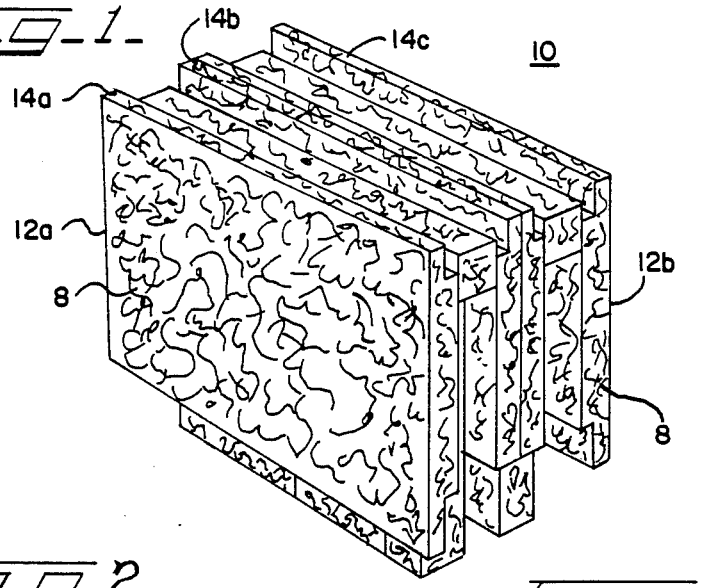
FIG. 1 a perspective view of the dining table in the closed position which comprises a stand-alone work of art.

FIG. 1 is a prospective view of a folding gateleg table 10, capable of serving as a formal dining table or a conference table in its fully opened position, and which connotes a stand-alone work of art (e.g., piece of sculpture or painting) in its fully closed position. Each of the exterior or interior surfaces or edges of the table 10, which are in plain view or observation, have a coherent 2-dimensional artistic design, mural or graphic representation 8, which portray a central artistic theme. This central artistic theme is intentional fanciful and manufactured of suitable materials such as enamels, acrylics or paints of some other hard plastic-like material (such as various colorful or graphic laminates). The specific artistic effect may be custom designed to the specification of the owner. Essentially, any desired aesthetic effect may be incorporated by the manufacturer of this table. The utilitarian aspects of the table 10 are consistent with standard carpentry practices common to the industry.

The folding gateleg table 10 signifies that each side of the table has a respective drop-leaf member **12*a* and 12*b* which will lift upward in a substantially vertical fashion to a fully extended and predetermined position. This will facilitate either partial utilization of the table (seating up to four individuals) or full utilization of the table (seating up to twelve individuals) as the circumstances dictate. When in the fully closed position, the table 10 has three separate top members 14*a*, 14*b* and 14*c*, which lay in the same general horizontal plane with each other and extend the entire width of the table 10. Although the exact specifications may vary, the table 10 in FIG. 1 has a height of 29 inches and when in the closed position, as depicted in FIG. 1**, has a width of 40 inches and a length of 16 inches.

Figure 2:
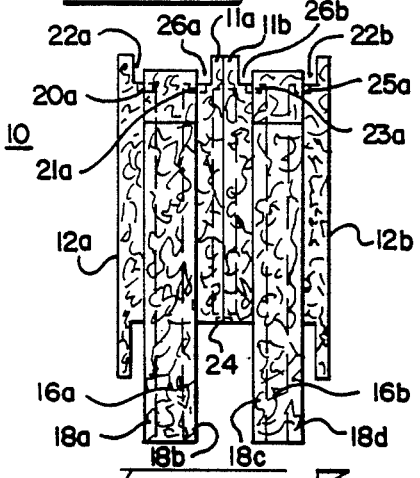
FIG. 2 is a side view of the dining table when in the fully closed position illustrating a stand-alone work of art (e.g., piece of sculpture).

FIG. 2 is a side view of the folding gateleg table 10 when the table is in its fully closed position. The folding gateleg table 10 has two main legs **16*a* and 16*b* which extend along the entire width of table 10 and provide the central support structure for table 10. Each drop-leaf member 12*a* and 12*b* has a respective cut-out section 22*a* and 22*b*, and a set of concealed inlaid hinges 20*a*, 20*b* , 20*c* and 25*a*, 25*b*, 25*c* (only 20*a* and 25*a* are shown in FIG. 2) to permit lifting of the respective drop-leaf member in an upward and vertical fashion to its extended position. Separate gateleg support members 18*a* , 18*b* , 18*c* and 18*d* are housed, when table 10 is in the closed position, within respective interior cavities (shown by dashed lines in FIG. 2), which are located in each individual side of each main legs 16*a* and 16*b*. Each gateleg support member 18 is mounted on hardware consisting of a standard furniture hinge (not shown) which is inlaid to facilitate the required pivoting action of the gateleg member 18 in a horizontal plane. Each gateleg support member 18***a* and 18*d* provides the necessary support to an associated drop-leaf member 12*a* and 12*b*, after the drop-leaf member 12 has been lifted to its fully extended position, as the gateleg support member 18*a* and 18*b* is operationally positioned beneath. In an alternative embodiment, gateleg support members 18 may have concealed inlaid swivels located at their top and bottom ends in order to facilitate its horizontal movement.

In the closed position, table 10 has center table top members 11*a* and 11*b* closed in accordion-like fashion, the closure being facilitated by an inlaid piano hinge 24 or other suitable running hinge. The piano hinge 24 extends along the entire width of table 10 and is mounted along the bottom adjoining edges of center table top members 11*a* and 11*b*. In order to facilitate lifting of the center table top members 11*a* and 11*b* in a substantially vertical and upward fashion to their fully extended position, each center table top member 11*a* and 11*b* has a respective cut-out section 26*a* and 26*b* which extend along the entire length of center table top members 11*a* and 11*b* and which work in conjunction with a respective set of concealed inlaid hinges 21*a*, 21*b*, 21*c* and 23*a*, 23*b*, 23*c* (only 21*a* and 23*a* are shown in FIG. 2) and piano hinge 24 to facilitate lifting of center table top members 11*a* and 11*b*. Respective gateleg support members 18*b* and 18*c* provide the required support to respective center table top members 11*a* and 11*b*.

Figure 3:
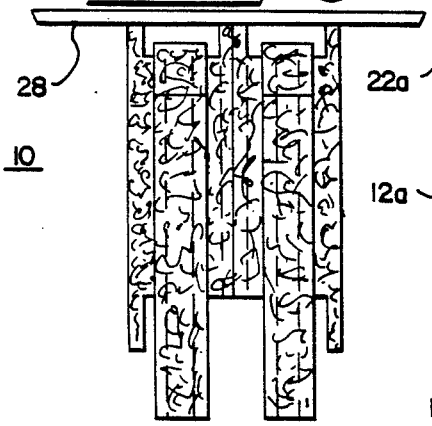
FIG. 3 is a side view of the dining table when in the fully closed position having a removable top.

FIG. 3 is a side view of an alternate embodiment of the folding gateleg table 10 in the fully closed position with a removable glass top 28 placed across the top most members 14*a*, 14*b* 14*c*. In this fashion, when the table 10 is in the fully closed position, an accessory removal top 28 can be used to provide a top working surface in the same horizontal plane. This removal top 28 may be clear, translucent, or opaque, as well as of a complementary color or artistic design, without detracting from the overall aesthetic nature of stand-alone work of art. Although the exact specifications may vary, the table 10 in its fully closed position with its removable top in place, as depicted in FIG. 3, has a width of 40 inches, a length of 16 inches and a height of 30 inches.

Figure 4:
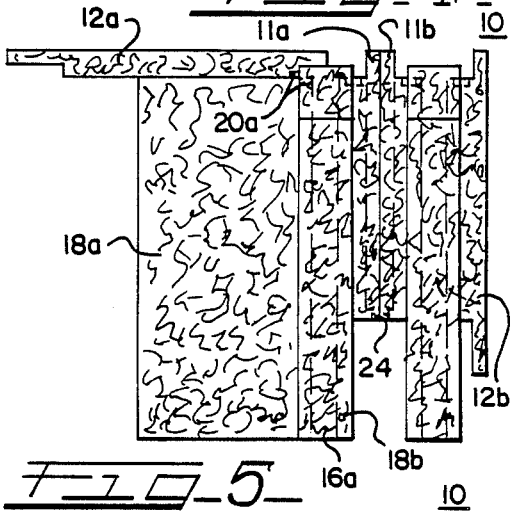
FIG. 4 is a side view of the dining table when in the semi-opened (e.g., one-quarter) position to facilitate seating of up to four individuals.

FIG. 4 is a side view of the folding gateleg table 10 with a drop-leaf member 12*a* placed in its fully extended position and supported by an associated gateleg support member 18*a*. Conventional concealed inlaid hinges 20*a* along with cut-out section 22*a* facilitate vertical lifting of the drop-leaf member 12*a* to its fully extended position, after which respective gateleg support member 18*a* is pivoted horizontally to its fully extended position upon which drop-leaf member 12*a* rests. In this manner, the table 10 may be partially opened to accommodate up to four individuals. There is no need to secure drop-leaf member 12*b* to its fully extended position. Likewise, the center most table top members 11*a* and 11*b* need not be secured to their respective fully extended positions. Although the exact specifications may vary, the table 10 when in its partially opened position, as shown in FIG. 4, has a length of 36 inches, a width of 40 inches and a height of 30 inches.

Figure 5:
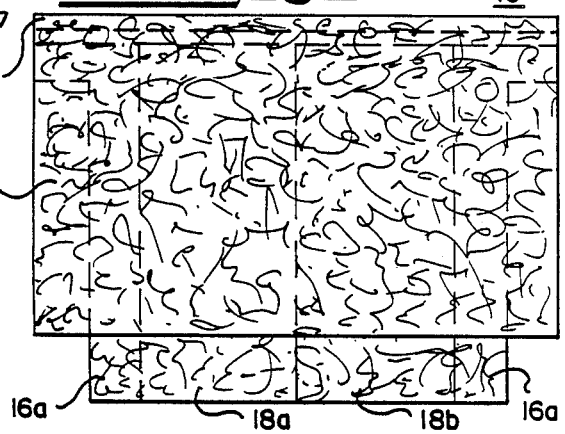
FIG. 5 is a frontal (or end) view of the dining table when in the fully closed position with an artistic painting covering its entire surface and edges.

FIG. 5 is a frontal (or end) view of the folding gateleg table 10 when in the fully closed position. The exterior and interior surfaces and edges of the gateleg table 10 has an overall artistic painting 8 comprising a stand-alone work of art. Each respective side of main leg 16*a* has a concealed interior cavity (shown by the dashed lines in FIG. 5) to facilitate housing of the gateleg support members 18*a* and 18*b* when not in use. Drop leaf member 12*a* has a cut-out section 22*a* which extends along its entire width to facilitate lifting of the drop-leaf member 12*a* to its fully extended and supported position. As has been previously stated, drop-leaf member 12*a* will be lifted to its fully extended position by the use of a set of concealed hinges 20*a*, 20*b* and 20*c* positioned along its width (see FIGS. 2 and 6). Although the exact specifications may vary, the table 10, when in the fully closed position as depicted in FIG. 5, has a height of 29 inches, a width of 40 inches and a length of 16 inches.

Figure 6:
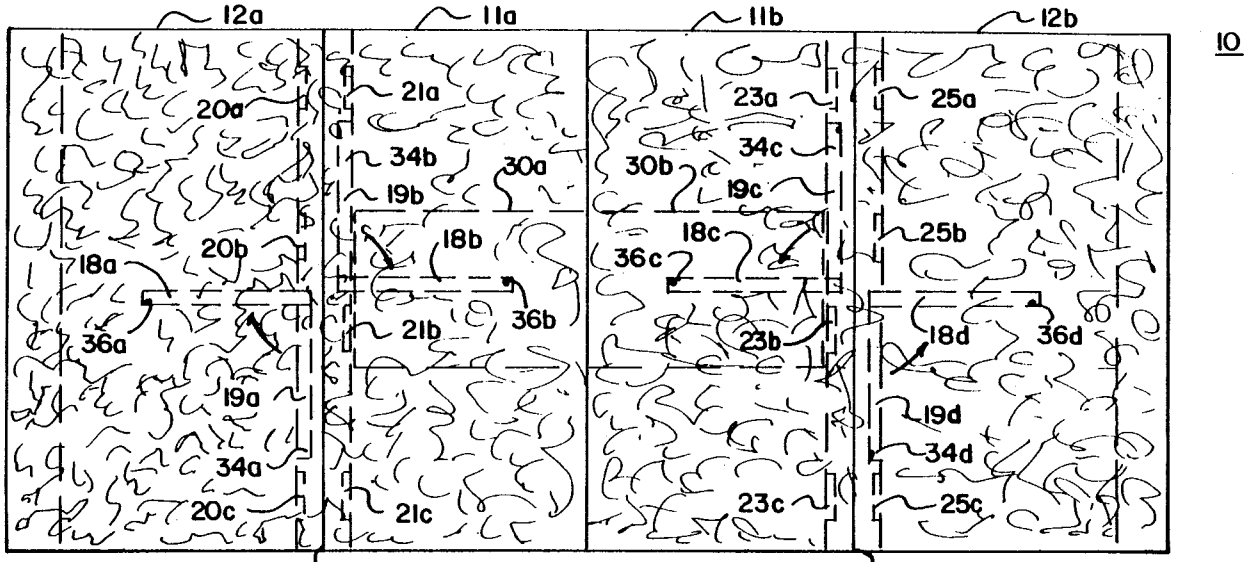
FIG. 6 is a top view of the dining table when in the fully opened position.

FIG. 6 is a top view of the folding gateleg table 10 in its fully extended or opened position. Each of the gateleg support members 18*a*, 18*b*, 18*c* and 18*d* have been pivoted horizontally from their associated recess area 19*a*, 19*b*, 19*c* and 19*d* to their fully extended position in order to support their respective drop-leaf member 12*a*, drop-leaf member 12*b*, center table top member 11*a* and center table top member 11*b*.

Four sets of concealed inlaid hinges provide the vertical lift or pivot action required by respective drop-leaf member 12*a* (20*a*, 20*b* and 20*c*), center table top member 11*a* (21*a*, 21*b* and 21*c* ), center table top member 11*b* (23*a*, 23*b* and 23*c*) and drop-leaf member 12*b* (25*a*, 25*b* and 25*c*).

In an alternate embodiment, a centrally recessed heating area 30*a* and 30*b* in center table top members 11*a* and 11*b* provide the table 10 with integral heating elements consisting of conventional conductive wires that are interlaced below the the surface of the heating area 30*a* and 30*b* so as not to detract from the aesthetic nature of the overall table 10. The heating element area 30*a* and 30*b* provide table 10 with the capability of having a warming area (up to 250 degrees F.) upon which food items may be maintained at a warming temperature. The heating element area 30*a* and 30*b* require a connection to a conventional AC power source (not shown) and is distinguished by silver marking on the surface.

Each gateleg member 18*a*, 18*b*, 18*c* and 18*d* have a respective magnetic catch 34*a*, 34*b*, 34*c* and 34*d* and an associated metallic release 36*a*, 36*b*, 36*c* and 36*d* positioned in such a manner as to be able to house gateleg support members 18 in their respective interior cavities 19*a*, 19*b*, 19*c* and 19*d* (shown by dashed lines in FIG. 6), which are contained in respective main leg members 16*a* and 16*b*. Although the exact specifications may vary, the table 10, when extended to its fully opened position, has an overall length of 88 inches, an overall width of 40 inches and an overall height of 30 inches.

Figure 7:
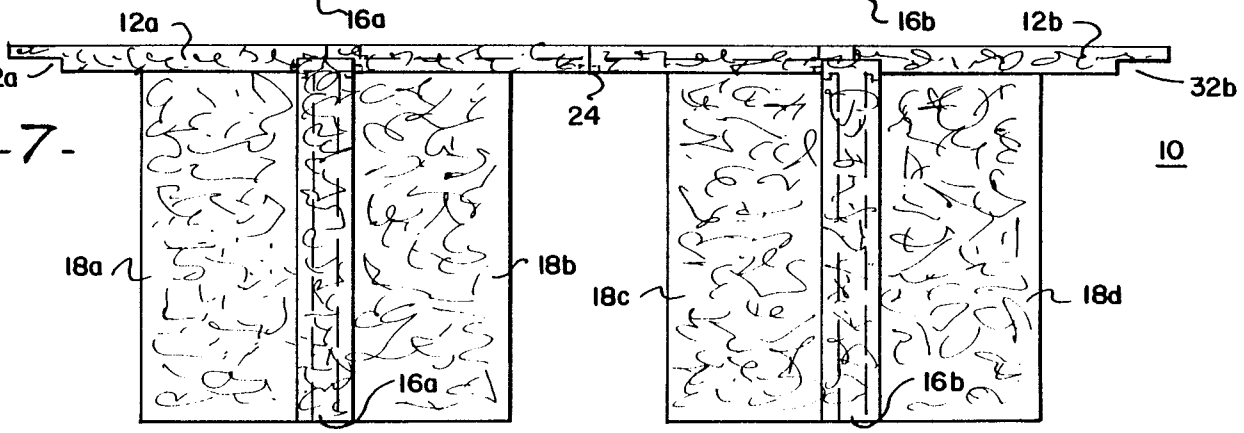
FIG. 7 is a side view of the dining table when in the fully opened position.

FIG. 7 is a side view of the folding gateleg table 10 in its fully opened position. Additional cut-out sections 32*a* and 32*b* extend the entire width of the table 10 and are present to balance the aesthic nature of the overall stand-alone work of art.

Figure 8:
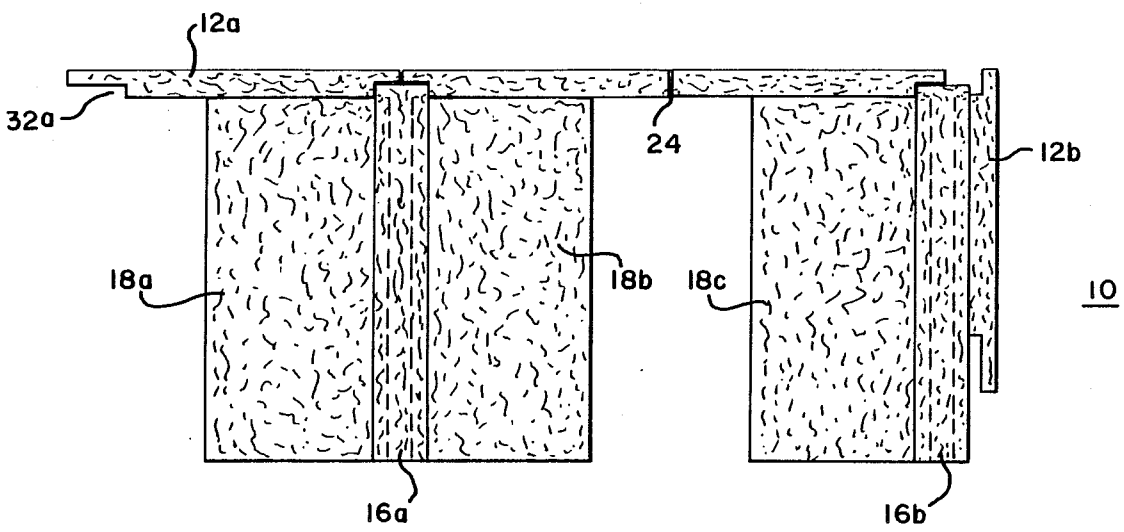
FIG. 8 is a side view of the dining table when in the semi-opened (e.g. three-quarter) position to facilitate seating of up to eight individuals.

FIG. 8 is a side view of the folding gateleg table 10 in another semi-opened (three-quarter) position capable of seating up to eight individuals. In this position one drop-leaf member 12*a* is placed in its fully extended position and supported by an respective gateleg support member 18*a*; in a similar fashion the pair of center table top members 11*a* and 11*b* are extended to their fully extended position and supported by respective gateleg support members 18*b* and 18*c*.

The preceding description is intended to illustrate the preferred embodiments of the invention. It is intended to illustrate and not to limit the scope of the invention, which extends to the breadth of the following claims, which particularly point out and distinctly claim the subject matter which is regarded as the invention.

I claim:

1. A gateleg table having an opened position, a plurality of partially opened positions and a closed position, the table having a plurality of exterior and interior surfaces, the table comprising in combination:

a pair of base support members, each support member having a pair of sides, each side having a respective interior cavity of a predetermined size;

a pair of rectangularly-shaped drop-leaf members having a width of a predetermined dimension, each drop-leaf member operatively connected to a respective side of said support member, each drop-leaf member having a first surface and second surface opposite the first surface, each drop-leaf member having a continuous rectangular portion removed along its entire width on said second surface;

a pair of adjacent rectangularly-shaped surface members having a width of a predetermined dimension, each surface member operatively connected to a respective side of said support members, each surface member having a first surface and a second surface opposite the first surface, each surface member having a continuous rectangular portion removed along its width on said second surface;

a hinge facilitating closing of the table to said closed position and longitudinally extending substantially the entire width of said surface members, said hinge operatively mounted to the adjacent second surface of each surface member;

means to pivot each drop-leaf member in substantially a vertical direction, said means operatively connected to a respective side of said support members and to the second surface of said drop-leaf members;

means to pivot each surface member in substantially a vertical direction, said means operatively connected to a respective side of said support members and to the second surface of said surface members;

a plurality of secondary support members of a predetermined size, each secondary support member having an extended position, said secondary support members housed in said respective cavity when not in their extended position; and means to pivot the secondary support member in a substantially a horizontal direction to their extended position.

2. The table of claim 1 wherein when in the closed position the table has a first position and a second position opposite the first position, wherein the table has a plurality of support members which lay in substantially the same horizontal plane relative to the first postion, thereby providing support means to a removable top surface member of a predetermined size.

3. The table of claim 1 wherein said means to pivot each drop-leaf member or surface member in substantially a vertical direction comprise a plurality of hinges positioned at a respective predetermined location in the side of the base support member and in the second surface of the respective drop-leaf member or surface member.

4. The table of claim 1 wherein said means to pivot each secondary support member in substantially a horizontal direction comprise a plurality of hinges positioned at a respective predetermined location in the interior cavity of the base support member and in an adjacent side of an associated secondary support member.

5. The table of claim 1 wherein said means to pivot each secondary support member in substantially a horizontal direction comprise a plurality of swivels positioned at a respective predetermined location in the interior cavity of the base support member and in the respective secondary support member.

* * * * *